United States Patent [19]

Most, Jr.

[11] 4,444,710

[45] Apr. 24, 1984

[54] PROCESS FOR INCREASING VOID VOLUME OF HOLLOW FILAMENTS

[75] Inventor: Elmer E. Most, Jr., Kinston, N.C.

[73] Assignee: E. I. Du Pont de Nemours and Company, Wilmington, Del.

[21] Appl. No.: 350,346

[22] Filed: Feb. 19, 1982

[51] Int. Cl.[3] ..... D01D 5/24

[52] U.S. Cl. ..... 264/209.5; 264/234; 264/288.8; 264/289.3; 264/345

[58] Field of Search ..... 264/177 F, 288.8, 210.3, 264/235

[56] References Cited

U.S. PATENT DOCUMENTS

| | | | |
|---|---|---|---|
| 2,578,899 | 12/1951 | Pace | 264/210.1 |
| 3,030,173 | 4/1962 | Kurzke et al. | 264/210.1 |
| 3,156,607 | 11/1964 | Strachan | 264/177 F |
| 3,426,754 | 2/1969 | Bierenbaum et al. | 264/210.3 |
| 3,513,110 | 5/1970 | Noether | 264/210.3 |
| 3,924,988 | 12/1975 | Hodge | 425/461 |
| 4,290,987 | 9/1981 | Soehngen et al. | 264/235 |

FOREIGN PATENT DOCUMENTS

| | | | |
|---|---|---|---|
| 55-137208 | 10/1980 | Japan | 264/177 F |
| 838141 | 6/1960 | United Kingdom . | |

*Primary Examiner*—Jay H. Woo

[57] ABSTRACT

A process for increasing the percent void of hollow filaments by contacting the filaments with water at a temperature of at least about 92° C. for at least about 3 seconds. It is necessary that the treatment be carried out while the filaments are in an amorphous condition. Preferred filaments are polyesters.

12 Claims, 3 Drawing Figures

PROCESS FOR INCREASING VOID VOLUME OF HOLLOW FILAMENTS

BACKGROUND OF THE INVENTION

This invention relates to a process for increasing the void percent of a hollow filament.

It is known in the art to produce hollow filaments by spinning multiple molten streams through a spinneret and coalescing the streams while they are still sufficiently tacky to form a bond. See Br. Pat. No. 1,106,263.

It is also known that freshly formed polyester structures may be permanently extended many times their length (up to 75 times) if the extending process is done under the proper conditions. See, for example, Pace U.S. Pat. No. 2,578,899. The extending process is carried out under low tension, at a slow rate and at a temperature 20° C. to 60° C. above the apparent minimum crystallization temperature.

SUMMARY OF THE INVENTION

The present invention is a process for increasing the void percent of hollow filaments. This result is accomplished by contacting a freshly formed hollow filament in its substantially amorphous state with water or water vapor at a temperature at least about 92° C. for a time of at least about 3 seconds. The hollow filament may be (and preferably is) extended slowly and at low tension in its lengthwise direction while in contact with the water. If the filament is extended lengthwise while the fiber is in contact with the water, the amount of extension may be many times the original length. the slow extension at low tension produces little, if any, orientation. The now distended filament may then be drawn in a conventional manner, i.e., at high speed and under high tension to orient the filament. This conventional drawing may take place in water at about 92° C. or above if desired. The resulting filament has a high void volume percentage, low elongation and high strength.

DETAILED DESCRIPTION

Figure 1:
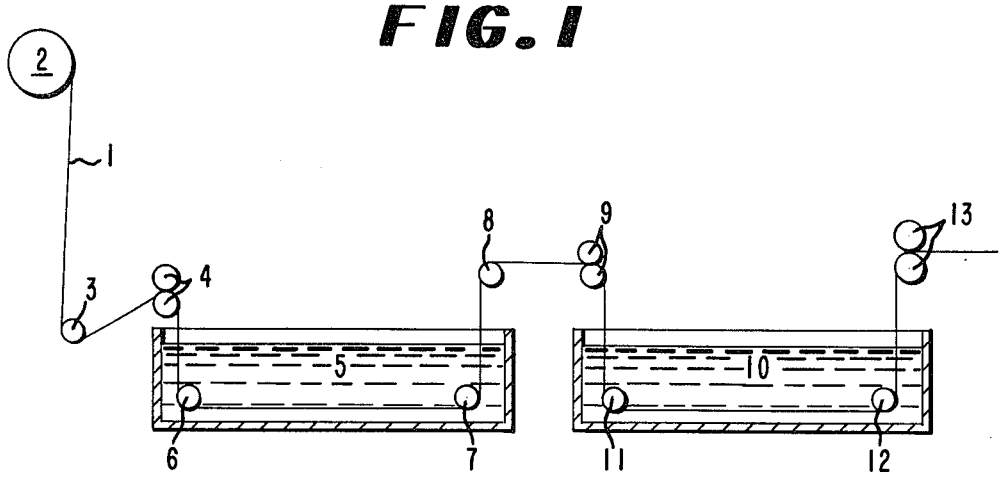
FIG. 1 is a schematic illustration of a preferred process of preparing filaments having a high percentage void volume.

Hollow filaments are an item of commerce and are employed in various products such as filler for sleeping bags, pillows and cold weather clothing. Hollow filaments are also used in the fabric of thermal underwear, in single use diapers and other absorbent materials including bandages, towels, napkins and the like. Hollow filaments are also used in the demineralization of water. In some uses for hollow fibers, such as fillers for thermal insulation, it is advantageous to have the void volume at a relatively high level since the insulation property is enhanced by the additionally entrapped air. In the past, it has been possible to exercise some control over the void volume of hollow filaments by changing the size and shape of the spinneret, i.e., spinning control. It is desirable to be able to have further control over the void volume of a hollow fiber. The present invention provides an improved control over the void volume of hollow filaments produced by melt spinning of a thermoplastic fiber-forming polymer.

The art discloses forming hollow fibers by melt spinning a polymer through a spinneret having C or V shaped orifices. The open ends of the C or V shaped orifices face a second orifice. Polymer streams spun from the two orifices unite at their edges to form a hollow filament. See, for example, Br. Pat. No. 1,160,263. Hollow filaments are also formed by extruding clusters of round or crescent shaped filaments that coalesce to form a hollow filament. See, for example, Br. Pt. No. 838,141. The present invention can employ these prior art methods of hollow filament formation, and then subject the filament to the treatment herein described to increase the volume of the void.

Filaments freshly spun at low or moderate speeds from molten polyester are amorphous and substantially unoriented. Filaments of polyethylene terephthalate remain in the amorphous state for some time after the fibers are cooled to below their crystalline melting point. It has been determined experimentally that polyester fibers are sufficiently crystallized in about seven days after production that the process of the present invention is substantially less efficient in increasing void volume. Thus the process works best on filaments less than about 7 days old and is preferably practiced with freshly-formed filaments. Filaments in their amorphous state may be extended without substantial crystallization or orientation. See Pace U.S. Pat. No. 2,578,899. The amount of crystallization that occurs while extending a filament of amorphous polyethylene terephthalate depends to some degree on the temperature at which the extension takes place and the presence of plasticizing molecules in the polymer. It has been found that in freshly formed hollow filaments the void volume can be increased, i.e., the filament distended—extended circumferentially—, while the filament is in the amorphous state if the filament is in contact with moisture at a temperature of at least about 92° C. The void volume can be further increased by use of water under greater than atmospheric pressure and therefore at temperatures greater than 100° C., or by use of steam. While the filament is in contact with water at a temperature of at least about 92° C., the filament may be extended lengthwise slowly, at low tension, or the filament can be kept at constant length while in contact with the hot water, or the filament may be allowed to retract in its lengthwise dimension during the contact with the hot water. In most circumstances the filament should be in contact with the water for about 3 to 75 seconds. Usually the wall thickness of the undrawn hollow filaments that may be treated by the process of this invention is in the range of about 0.001 to about 0.01 mm. Usually such filaments have a denier of about 3 to 35.

After the hollow filament has been distended by its treatment with hot moisture, it may then be drawn in the conventional fashion to form an oriented, crystalline, strong filament. Such drawing can take place in hot water if desired. Such drawing is accomplished at higher speeds and higher tension that the previously described filament extension. The drawn filament is, of course, reduced in diameter, but the percent void is unchanged in this step.

FIG. 1 represents a preferred mode of preparing the high void volume filaments. Filaments 1 are fed from roll 2, around roll 3 and between pinch rolls 4 and into hot water bath 5. The filaments pass around rolls 6, 7 and 8. Rolls 3, 4 and 6 are driven at speed $S_1$, and rolls 7 and 8 are driven at speed $S_2$. $S_2$ is greater than $S_1$, and the filaments are extended as they pass between rolls 6 and 7. The extended filaments then pass between pinch rolls 9 and into a draw hot water bath 10, around rolls 11 and 12, and between pinch rolls 13, and are forwarded to a windup (not shown). Rolls 9 and 11 are driven at the same speed as rolls 7 and 8, and rolls 12 and 13 are driven at speed $S_3$ which is greater than $S_2$—thus drawing the filaments in bath 10.

Figure 2:
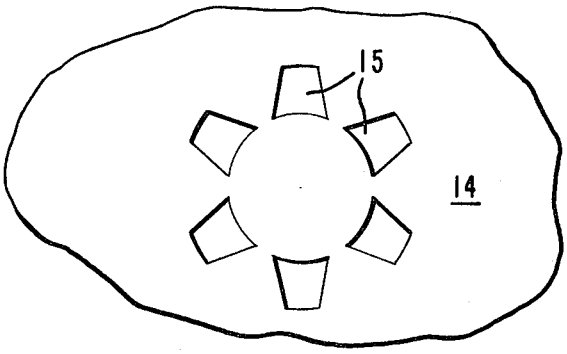
FIG. 2 is a view of a section of a spinneret showing one cluster of six orifices. A spinneret having such a cluster of orifices would be suitable to form a filament having a centrally located void.

FIG. 2 shows a greatly enlarged section of a metal spinneret plate 14 having six apertures 15 located in a circular arrangement.

Figure 3:
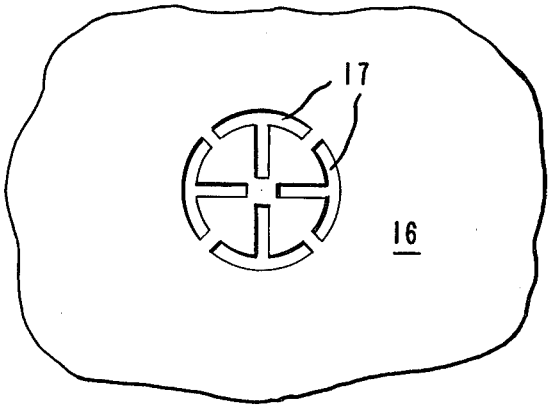
FIG. 3 is a view of a section of a spinneret suitable for making a filament having four voids; one in each quadrant of its cross-section.

FIG. 3 shows a greatly enlarged section of a metal spinneret plate 16, having four roughly "T" shaped apertures 17 located in such a manner that the arms of the "T" form a circular arrangement.

In the following examples, which illustrate the invention, all parts and percentages are in parts by weight unless otherwise noted.

EXAMPLE I

Hollow copolyester filaments having grooves that extend longitudinally along the outer surface of the filaments were prepared using spinneret capillaries like those illustrated in FIG. 2. The copolyester is an ethylene terephthalate polymer in which 2 weight percent of ethylene 5-(sodium-sulfo) isophthalate has been copolymerized into the polymer chains. One of the spinnerets had 66 holes (66 clusters of capillaries) arranged in two concentric circles; the other had 99 holes (99 clusters of capillaries) in three concentric circles. In FIG. 2, the bases of the roughly triangular capillaries in the cluster lie on the circumference of a circle. The distance between adjacent capillaries along this circumference is 0.0457 mm. The area of each hole in the spinneret was about 0.0122 $mm^2$. Part of the product was spun using one spinneret; part using the other. All of the yarn was spun at 1200 ypm (1097 mpm) with a spinning block temperature of 266° C. The denier per filament of the spun yarn was 7.4 (8.2 dtex). The relative viscosity (LRV) of the polymer of the yarn was 11.3. The term "LRV" is the ratio at 25° C. of the flow times in a capillary viscometer for a solution and solvent. The solution was 4.75 weight percent of polymer in solvent. The solvent is hexafluoroisopropanol containing 100 ppm $H_2SO_4$. The spun yarn was treated on a draw machine equipped with feed rolls, draw rolls and two hot water baths. The yarn was extended 1.6X, without orientation in a boiling water (about 100° C.) bath at a tension below 0.1 g per denier (0.09 gram per dtex). The yarn was then drawn 3.75X at normal tension, about 2.5 grams per denier (2.25 grams per dtex) in a 96° C. water bath containing a little yarn finish. The drawn product, having a denier of 1.25 (1.9 dtex) per filament was then wound to a package.

The average percent void values for fibers in the spun yarn (yarn prior to treatment) and in the drawn product (yarn after treatment) were determined. The spun yarn void content was 9.0%; the drawn product void content was 27%. These determinations were made by flotation density as follows:

A series of solutions of varying density is prepared by combining the appropriate amounts of $CCl_4$, density 1.60 gm/cc, and n-heptane, density 0.684 gm/cc. Densities of these solutions may be determined accurately by measuring with a hydrometer. The solutions are lined up in order of increasing density. Then the apparent density of a hollow fiber is determined by cutting a short length (100–150 mm) of the fiber, tying it into a very loose knot, and immersing it in each of the solutions in turn to determine in which solution the fiber just floats and in which solution it just sinks. The average of these two densities is the apparent density of the fiber. Then percent void in the spun or drawn fiber is:

$$\text{Spun \% Void} = \frac{1.345 - \text{Apparent Density}}{1.345} \times 100$$

$$\text{Drawn \% Void} = \frac{1.39 - \text{Apparent Density}}{1.39} \times 100$$

Where:

1.345 is the polymer density in undrawn (amorphous) polyester fiber 1.39 is the polymer density in drawn (crystalline polyester fiber)

EXAMPLE II

Polyethylene terephthalate yarns of hollow rounf filaments were spun at 787 ypm (720 mpm) and wound on spools. The spinneret employed has extrusion orifices like that illustrated in FIG. 1 of U.S. Pat. No. 3,924,988 to Hodge. The yarn has 450 filaments with a diameter per filament of 16.9 (18.8 dtex). The relative viscosity of the yarn polymer was determined as in Example I, and found to be about 19.5. The percent void of the filaments was measured by flotation density and determined to be 16. A sample of the spun yarn was boiled in water for 60 seconds without longitudinal tension, i.e., it was free to shrink. The yarn developed so much void that the percent void could not be measured in the density liquids. It floated in n-heptane which has a density of 0.684 g/ml. Thus, the void level was greater than 51%. Another sample of the spun yarn was boiled for 60 seconds while being held at constant length. This sample has a percent void of 44.

An additional sample of the spun yarn was treated on a draw machine under conditions similar to those in Example I. The yarn from the draw machine was taken up at 50 ypm (46 mpm). The yarn was extended 1.72X without orientation in the water at about 100° C. The yarn was in the about 100° C. water for about 6 seconds. The yarn was drawn 3.49X in the second water bath, maintained at about 96° C., with orientation. The final drawn product had a percent void of 22–25 as measured by flotation density.

EXAMPLE III

Polyethylene terephthalate having a relative viscosity as determined in Example I of 19.5 was spun into round hollow-filament yarns at 1000 ypm (914 mpm), using 450-hole spinnerets. The spinneret orifices were the same shape as those of Example II. The filaments, which have a denier of 6.5 (7.2 dtex) a percent void of 19, and a wall thickness of about 0.0024 mm are extended 1.52X in a 100° C.-water bath, drawn 3.29X in a water bath having a temperature of 95° C. and wound up at 41 ypm (37.5 mpm).

The drawn product was then mechanically crimped, relaxed for 8 minutes in a hot air oven at 130° C., and cut to 1.5-inch (3.8-cm) staple. The crimped, relaxed staple had percent void of 38.5 and a denier per filament of 1.5.

EXAMPLE IV

Polyethylene terephthalate was spun at 1400 ypm with a spinning block temperature of 304° C. The yarn polymer had a relative viscosity of 20.4. The filaments have a trilobal cross-section, a denier of 6.18 (6.87 dtex) and a percent void of 9. The spun yarn was passed into a 100° C. water bath for about 6 seconds where it was extended longitudinally 1.52X, and then passed into a second water bath at 95° C. where it was drawn 3.29X. The yarn was wound up at 41 yards (37.5 mpm) per minute. The drawn product has a percent void of 22. After mechanical crimping, the product has a percent void of 14–16 and a final denier per filament of 1.65 (1.8 dtex).

EXAMPLE V

A copolyester having a relative viscosity of 21.5 is spun into quadrilobal hollow filaments at 1175 ypm (1074 mpm). The copolyester is an ethylene terephthalate containing 5%, by weight, of glutarate units. The filaments had 4 voids, one in each quadrant, a pecent void of 12, denier of 25 (dtex of 27.8) and a wall thickness of about 0.010 mm. The hollow fiber was produced by spinning molten polymer through a spinneret of the configuration illustrated in FIG. 3. The percent void increased to 29 when the spun yarn was immersed in boiling (100° C.) water for 6 seconds. Immersion in boiling (100° C.) water for 60 seconds also resulted in a percent void of 29. The spun yarn was treated in two successive draw baths as follows:

| | FIRST BATH CONDITIONS | | | SECOND BATH CONDITIONS | | | PERCENT VOID | |
|---|---|---|---|---|---|---|---|---|
| SAMPLE | EXTENSION RATIO | TEMP. °C. | TIME SEC. | DRAW RATIO | TEMP. °C. | TIME SEC. | UNCRIMPED | CRIMPED |
| A | 1.057X | 100 | 4.3 | 2.70 | 90 | 4.3 | 26 | 20 |
| B | 1.10X | 100 | 7.5 | 2.73 | 90 | 7.5 | 24 | 22 |
| C (control) | 1.057X | 50 | 4.3 | 2.70 | 90 | 4.3 | 13 | 7 |

Items A and C were passed into a water bath for about 4.3 sec. where they were extended longitudinally 1.057X, then passed into a second water bath at 90° C., where they were drawn 2.70X. The yarn was wound up at 33.3 ypm (30.5 mpm), crimped, and relaxed for 10 min. in a hot air oven at 170° C.
Item B, from the same supply yarn, was passed into the 100° water bath for about 7.5 sec., where it was extended longitudinally 1.10X, then passed into a second water bath at 90° C., where it was drawn 2.73X. The yarn was wound up at 20 ypm (18.3 mpm), crimped, and relaxed for 10 min. in a hot air oven at 170° C.

EXAMPLE VI

A copolyester having a relative viscosity of 16 is spun into quadrilobal, hollow filaments at 1110 ypm (1015 mpm). The filaments had 4 voids, one in each quadrant, a percent void of 28 and a denier of 26.5 (dtex of 29.4). The hollow filaments developed greater than 51% void when immersed in boiling water for 60 seconds. In 98° C. water for 6 seconds, the hollow filaments developed 50% void; and, in 92° C. water for 6 seconds, 34% void.

The process of the present invention is preferably carried out on polyester filaments, such as terephthalate polyester filaments, for example polyethylene terephthalate homopolymer filaments; copolyesters containing polyethylene terephthalate units and ethylene 5-(sodium-sulfo) isophthalate units or dimethyl glutarate units; terpolyesters containing polyethylene terephthalate units, ethylene 5-(sodium-sulfo) isophthalate units, and dimethyl glutarate units, for example a terpolymer containing 2% by weight ethylene 5-(sodium-sulfo) isophthalate units and 3% by weight dimethyl glutarate units.

I claim:

1. A process for increasing the percent void of hollow polyester filaments which comprises melt spinning a hollow polyester filament, and while the filament is still substantially amorphous contacting the filament with water at a temperature at least about 92° C. for at least about 3 seconds.

2. The process of claim 1 in which the filament that is contacted with water at a temperature of at least about 92° C., is a freshly formed hollow filament, and said contact with water at a temperature of at least about 92° C. is for between 3 seconds and 75 seconds.

3. The process of claim 1 in which the filament is subsequently drawn at least about 2X.

4. The process of claim 1 in which the filament is longitudinally extended without orientation at least about 1.2X while it is in contact with water at a temperature of at least about 92° C.

5. The process of claim 4 in which the filament is subsequently drawn at least about 2X.

6. The process of claim 5 in which the filament is polyethylene terephthalate.

7. The process of claim 5 in which the filament is a copolymer of polyethylene terephthalate and dimethyl glutarate.

8. The process of claim 5 in which the filament has a single void located on the centered longitudinal axis of the filament.

9. The process of claim 5 in which the filament has four voids, one located in each quadrant of the filament when the filament is viewed in cross section at a right angle to the axis of the filament.

10. The process of claim 8 in which the filament has grooves in the outer surface that extend longitudinally along the filament.

11. The process of claim 1 in which the polymer is a polymer of ethylene terephthalate, 2% ethylene 5-(sodium-sulfo)isophthalate, and 3%, dimethyl glutarate.

12. A process for increasing the percent void of hollow polyester filaments which comprises melt spinning a polyester to form a substantially amorphous, substantially unoriented hollow filament thereof, contacting the filament with water at a temperature of at least about 92° C. for at least about 3 seconds while the filament remains substantially amorphous and substantially unoriented whereby the percent void is increased.

* * * * *